US005662563A

United States Patent [19]

Maerzke

[11] Patent Number: 5,662,563

[45] Date of Patent: Sep. 2, 1997

[54] FLEXIBLE ELASTIC EXERCISE DEVICE WITH HANDLE

[76] Inventor: James T. Maerzke, 3810 60th Pl., Kenosha, Wis. 53142

[21] Appl. No.: 645,078

[22] Filed: May 13, 1996

[51] Int. Cl.[6] ..... A63B 21/02

[52] U.S. Cl. ..... 482/126; 482/125

[58] Field of Search ..... 482/121, 122, 482/123, 124, 125, 126, 129, 130, 904, 44

[56] References Cited

U.S. PATENT DOCUMENTS

| | | | |
|---|---|---|---|
| 1,706,654 | 3/1929 | Christensen | 482/125 |
| 1,729,399 | 9/1929 | Noe | 482/126 |
| 1,832,633 | 11/1931 | Hendrickson | 482/126 |
| 1,884,392 | 10/1932 | Treat | 482/126 |
| 5,397,288 | 3/1995 | Sayre | 482/122 X |

*Primary Examiner*—Richard J. Apley
*Assistant Examiner*—William LaMarca

[57] ABSTRACT

The invention is a portable exercising device comprised of a flexible elastic material strap, held fixedly between three rods which are secured longitudinally by means of semi-rigid plastic caps at each end. The caps are removable from the rods in order to adjust the active length of the elastic material, adapting the tension of the elastic to the user's specific need. The grouped rods are embodied as the handle of the device as exercises are performed. The strap may be connected to a stationary object such as a door, or held by the users foot or other means. The device is used to perform exercises which tone and firm muscles of the user.

4 Claims, 3 Drawing Sheets

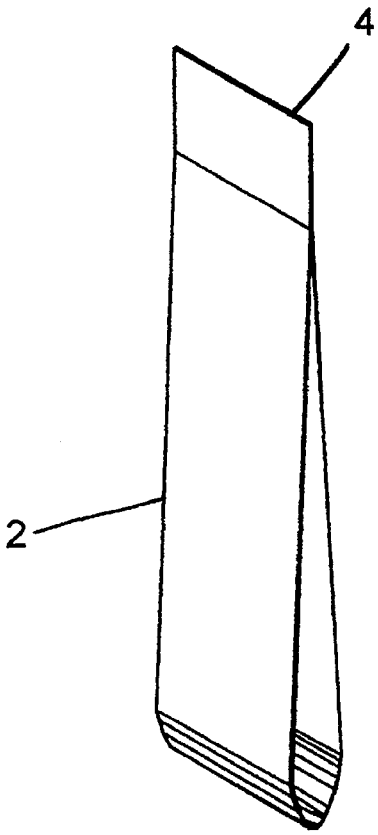
FIG. 5
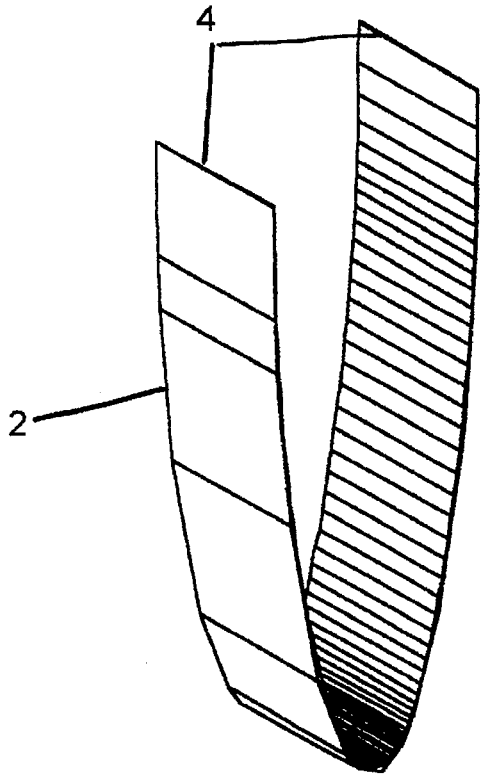

FLEXIBLE ELASTIC EXERCISE DEVICE WITH HANDLE

BRIEF DESCRIPTION OF DRAWINGS

FIG. 5 shows the elastic straps it is looped, and folded end to end for placement between the rods.

BACKGROUND OF THE INVENTION

Figure 1:
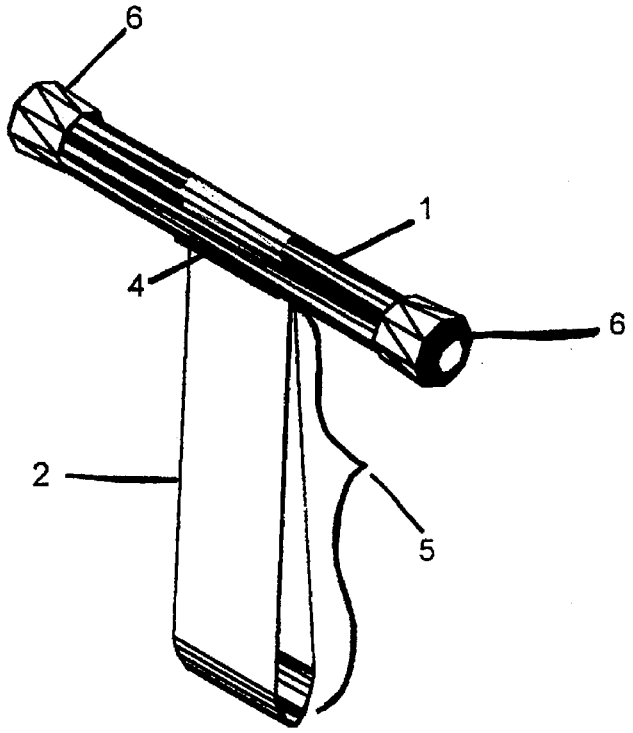
FIG. 1 is an assembly drawing of the exercise device

The present invention relates to an exercise device, used for firming and building muscle. As a hand held device, it is portable and therefore can be used at home, or taken along when traveling. The device can be used alone or with other equipment, as well as being connected to a stationary object for additional exercises.

U.S. Pat. No. 4,570,929 to Nancy A. Shoemaker has a prior art design described for an elastic exercise device in which the handles are loops fastened at the ends of the material. The elastic material itself is a predetermined length, therefore not tension adjustable.

U.S. Pat. No. 4,059,265 to Horst K. and Klaus A. Wieder has a prior art design described for an exerciser using an elastic cable or cord, threaded through a dual cylindrical passage in a grip handle. The grip handles of the device allows for some tension adjustment, and is provided for use with an elastic cable or cord. Performing various exercises requires additional apparatus included in the prior art.

There has always been a need for exercise equipment of various types and levels of expertise. As health consciousness consistently rises, the need for safe, easy and effective exercise equipment is also increasing. Not only for those who are practiced in the art, but those only beginning a health program as well. Current exercise devices similar to the present invention lack tension adjustment capability and devices of this type have limited use, that is, the user can only perform a given number of exercises with a single device. Some of the exercise devices now available are too costly to justify the means. The present invention helps to eliminate the above problems.

SUMMARY OF THE INVENTION

The improved exercise device is comprised of a handle which embodies three rods, gripping a length of flexible elastic material, held firmly together by means of caps at each end. The handle provides three things; a simple means of tension adjustment, a firm, non-slip grasp on the strap, and a safe and comfortable means for holding the device during use. The number of exercises associated with the present device are unlimited. Additionally, the versatility of this invention allows for the user to create their own personalized exercises.

The advantage and object of the present invention is the configuration of the rods in the handle, which grips the elastic strap. The strap is long enough to be adapted to tensions from very weak to very tense. By removing one or both of the caps, the length of the elastic strap can be easily adjusted and replacing the cap(s) retains the tight grip of the strap. Being able to change the length of the elastic strap empowers the user to start an exercise program at a weaker tension by keeping a longer active length and progressively adjusting to higher tension by shortening the active length at their own pace. By folding the entire length in half, the two ends of the elastic are placed together and gripped between the rods forming a large loop of elastic material. Having the length of elastic material open ended allows the user to attach it to a stationary object or other equipment and then gripping it within the handle, allowing unlimited uses. This device is constructed of inexpensive, obtainable materials, to keep the resulting cost low. The advantages and objects of the present invention will become more evident from the following description of the drawings.

DETAILED DESCRIPTION OF DRAWINGS

In FIG. 1, the flexible exercise device is shown as assembled. The handle 1 grips the flexible elastic strap 2 such that the ends 4 of the strap 2 protrude from the rods 1A,1B, & 1C. The caps 6 placed one on each end of the handle 1, fixedly restrain the rods 1A,1B & 1C causing a tight grip on the strap 2. As FIG. 1 shows the flexible elastic strap 2 is folded end to end for placement between the rods. Folding the strap 2 in this manner creates a loop of elastic which becomes the active length 5.

Figure 2:
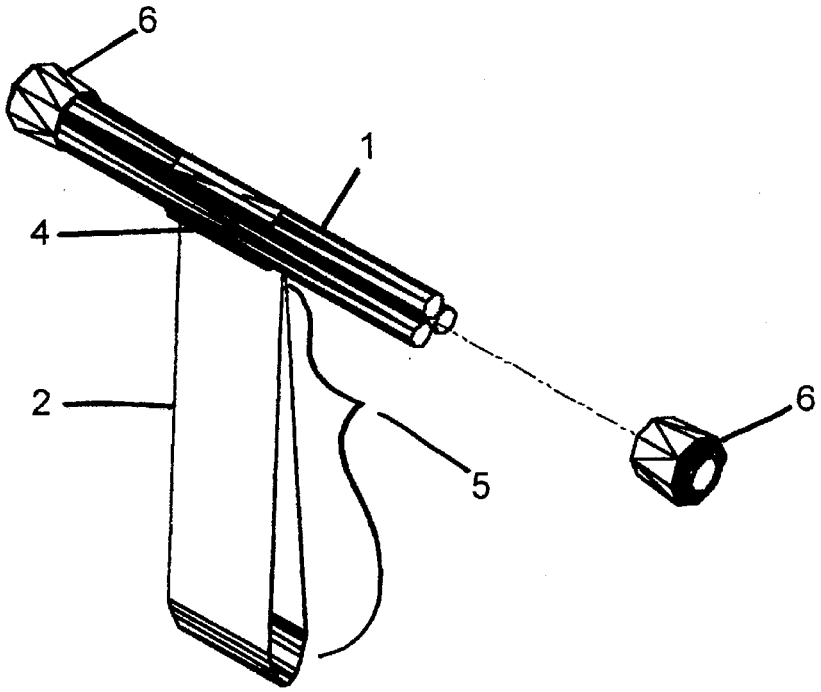
FIG. 2 is an assembly view with one end cap removed.

FIG. 2 shows one cap 6 removed from the handle 1. Removing one or both of the end caps 6, allows the flexible elastic strap 2 to be easily adjusted between the rods 1A,1B & 1C. If the open ends 4 of the strap 2 are moved so as to be farther away from the handle 1, the active length 5 of the strap 2 becomes shorter, increasing the tension of the device. Moving the ends of the elastic 4 closer to the handle 1, results in the active length 5 of the strap 2 to be longer thus reducing the amount of tension in the device.

Figure 3:
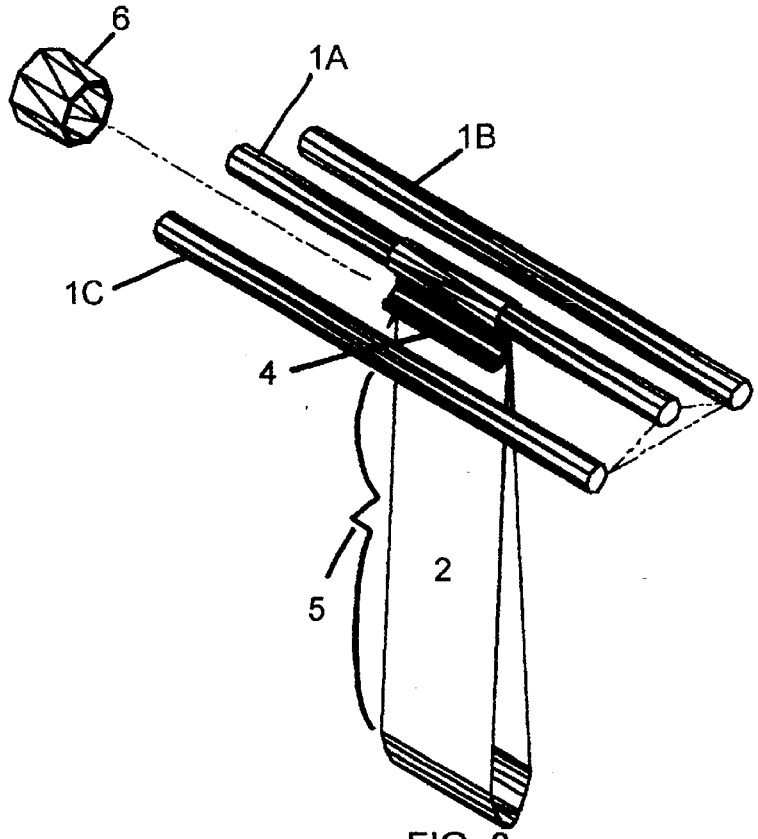
FIG. 3 is an exploded view of the assembled device.

FIG. 3 shows an exploded view of the assembly (with cap 6 removed.) The three rods 1A,1B & 1C are configured in a triangular shape to embody the handle 1. The open ends 4 of the elastic strap 2 are wrapped together such that its placement is around the uppermost rod 1A and cinched between the two lower rods 1B & 1C. With the handle 1 disassembled in this way, the strap 2 is adjusted to achieve the desired active length 5.

Figure 4:
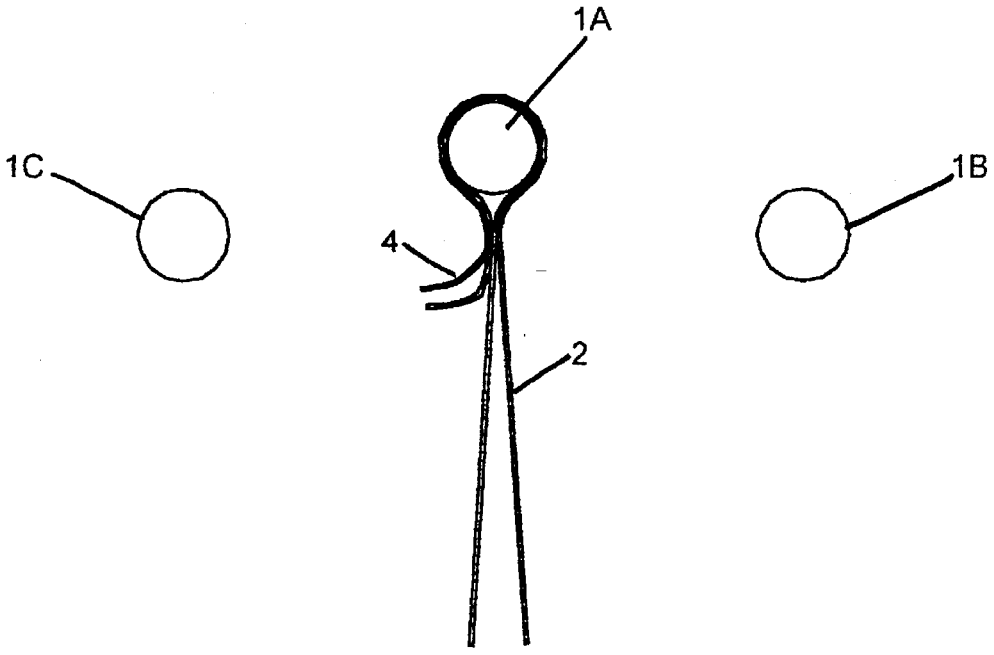
FIG. 4 is a side view of the position of the elastic material between the rods.

FIG. 4 shows an exploded end view of the handle 1 with the cap 6 removed. The path of the flexible elastic strap 2, between and around the rods 1A,1B & 1C, is easily visible from this view. The rods 1A,1B & 1C are themselves interchangeable because they are all of identical shape and size. However the placement of the elastic strap 2 relative to the rods 1A,1B & 1C is critical to ensure a tight grip when the cap 6 is replaced.

FIG. 5 shows a perspective view of folding the strap 2 to be placed into the handle. The two open ends 4 are brought together as the elastic strap 2 is folded over on itself. This creates the loop and becomes the active length 5 when gripped into the handle 1. When using the present invention with other equipment or a stationary object, the strap 2 may be first placed around the said equipment or object, then bringing the open ends 4 together and placing them in the handle 1, securing with the end caps 6.

What is claimed is:

1. An exercise device comprising;

a handle assembly, having three identical rods, where an external longitudinal surface of the first rod is on top and centered over an external longitudinal surface of the second and the third rod and where a left and right end of the first red are aligned with a respective left and right end of the second and third rod, two semi-rigid end caps, sufficiently sized to receivably attach the aligned left and right ends of the three rods, to secure the rods together, and a length of flexible elastic material, folded in half, matched first end to second end, and positioned between the longitudinal surfaces of the three rods where a section of the folded elastic material closest to the matched ends is wrapped around the longitudinal surface of the first top rod and cinched between the longitudinal surfaces of the second and third bottom rods thereby forming a loop of the elastic material whereby the loop can be engaged by a user to perform exercises.

2. The exercise device of claim 1 where said end caps are removably attached to the left and right aligned ends of the three rods thereby allowing for repositioning of the elastic material between the longitudinal surfaces of the rods and adjustment of the loop length of the elastic material thus providing for different tension settings for a user.

3. The exercise device of claim 1 where said end caps are rubber.

4. The exercise device of claim 1 where said end caps are plastic.

* * * * *